United States Patent [19]

Spatz et al.

[11] 4,113,282

[45] Sep. 12, 1978

[54] PRESSURE-SENSITIVE CARBONLESS COPY SYSTEM AND TRANSFER SHEET FOR USE THEREIN

[75] Inventors: Sydney Martin Spatz, Circleville, Ohio; Dale Richard Shackle, Scottsboro, Ala.

[73] Assignee: The Mead Corporation, Dayton, Ohio

[21] Appl. No.: 767,543

[22] Filed: Feb. 10, 1977

[51] Int. Cl.[2] ..... B41M 5/16; B41M 5/22

[52] U.S. Cl. ..... 282/27.5; 106/14.5; 106/21; 427/150; 428/307; 428/537; 428/914

[58] Field of Search ..... 106/19–21, 106/14.5, 24, 27, 28; 282/27.5; 260/471 R; 427/146, 150, 151, 153, 152; 428/323, 327, 411, 537, 913, 914, 307

[56] References Cited

U.S. PATENT DOCUMENTS

| | | | |
|---|---|---|---|
| 3,063,864 | 11/1962 | Norman | 428/195 |
| 3,432,327 | 3/1969 | Kan et al. | 260/29.1 R |
| 3,994,967 | 11/1976 | Ross | 260/519 |

OTHER PUBLICATIONS

Bluhm et al., "Photoisomerization of o–Nitrobenzyl Compounds", Journal of Organic Chemistry, vol. 29, pp. 636–640, 1964.

*Primary Examiner*—Thomas J. Herbert, Jr.
*Assistant Examiner*—Bruce H. Hess
*Attorney, Agent, or Firm*—Charles N. Shane, Jr.; Stephen H. Cagle; Wilson G. Palmer

[57] ABSTRACT

In accordance with one of its aspects, the pressure-sensitive carbonless copy system of this invention, wherein an acidic color precursor and a basic color developer are present, the color precursor and the color developer being co-reactive to form a color upon contact with one another in the presence of a carrier liquid and the color precursor being present in the system in solution in the carrier liquid, comprises an improvement wherein the color precursor is an organic acetate having the following formula:

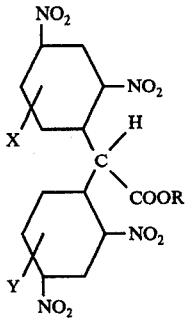

wherein R is selected from the group consisting of a $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ to $C_4$ chloroalkyl and the color developer is an alkaline color developer having a $pK_b$ of less than about 4.8.

In accordance with another aspect of this invention, the pressure-sensitive carbonless copy sheet of this invention comprises a substrate having a plurality of surfaces having applied thereto on at least one of the said surfaces a coating containing a solution of the organic acetate color precursor in a carrier liquid.

15 Claims, No Drawings

PRESSURE-SENSITIVE CARBONLESS COPY SYSTEM AND TRANSFER SHEET FOR USE THEREIN

BACKGROUND OF THE INVENTION

This invention relates to the production of a pressure-sensitive carbonless copy system and in particular to a system using a transfer coating composition containing a solution of an alkyl bis-(2,4-dinitrophenyl) acetate in a carrier liquid which composition is applied to a substrate.

Carbonless copy paper, briefly stated, is a standard type of paper wherein during manufacture the backside of the paper substrate is coated with what is referred to as a CB or transfer coating. The CB coating contains one or more color precursors generally in capsular form. At the same time the front side of the paper substrate is coated during manufacture with what is referred to as a CF or color-developing coating, which contains one or more color developers capable of producing a color with the color precursors. Both the color precursors and color developers remain in the coatings on the respective back and front surfaces of the paper in substantially colorless form. This is true until the CB and CF coatings are brought into overlying relationship and sufficient pressure, as by a typewriter, is applied to rupture the CB coating to release the encapsulated color precursor. At this time the color precursor contacts the CF coating and reacts with the color developer therein to form a colored image. Carbonless copy paper has proved to be an exceptionally valuable image transfer media for a variety of reasons one of which is the fact that until a CB coating is placed next to a CF coating both the CB and the CF are in an inactive state as the co-reactive color-forming elements are not in contact with one another. U.S. Pat. Nos. relating to the production of carbonless copy transfer or developer coated paper products which have been commercially successful are as follows: 2,712,507 (1955) to Green, 2,730,456 (1956) to Green et al, 3,455,721 (1969) to Phillips et al, 3,466,184 (1969) to Bowler et al, 3,672,935 (1972) to Miller et al.

A product which is in an advanced stage of development and commercialization at this time and which is available in some business sectors is referred to as self-contained paper. Very generally stated, self-contained paper refers to an image transfer system wherein only one side of the paper needs to be coated and the one coating contains both the color precursor, generally in encapsulated form, and the color developer. Thus when pressure is applied, again as by a typewriter or other writing instrument, the color precursor capsule is ruptured and reacts with the surrounding color developer to form an image. Both the carbonless paper image transfer system and the self-contained transfer system have been the subject of a great deal of patent activity. A typical autogeneous record material system, earlier sometimes referred to as "self-contained" because all elements for making a mark are in a single sheet, is disclosed in U.S. Pat. No. 2,730,457 (1956) to Green.

The aforementioned patents disclose systems using oil solutions of basic color precursors, such as the organic lactones, as the encapsulated color-forming material in combination with acidic electron acceptor coated developer sheets. Kan et al in U.S. Pat. No. 3,432,327 (1969) in Table 1 discloses a number of color-developing pairs which react to form colors in the presence of a hydrophilic liquid. In contrast, the micro-encapsulated color-forming materials of the instant invention are oil solutions of acidic color precursors, i.e., the alkyl bis-(2,4-dinitrophenyl) acetates and the color developer sheet contains a strong base, i.e., a base having a $pK_b$ below 4.8. Using the oil solutions of color-forming materials of the invention, micro-encapsulation of these solutions can be accomplished using known commercial processes. Microcapsules very stable to loss of internal contents or aging may be produced.

STATEMENT OF THE INVENTION

In accordance with one of its aspects, the pressure-sensitive carbonless copy system of this invention, wherein an acidic color precursor and a basic color developer are present, the color precursor and the color developer being co-reactive to form a color upon contact with one another in the presence of a carrier liquid and the color precursor being present in the system in solution in the carrier liquid, comprises an improvement wherein the color precursor is an organic acetate having the following formula:

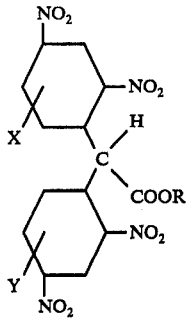

wherein R is selected from the group consisting of $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ to $C_4$ chloroalkyl and the color developer is an alkaline color developer having a $pK_b$ of less than about 4.8.

In accordance with another aspect of this invention, the pressure-sensitive carbonless copy sheet of this invention comprises a substrate having a plurality of surfaces having applied thereto on at least one of the surfaces a coating containing a solution of the organic acetate color precursor in a carrier liquid.

DETAILED DESCRIPTION OF THE INVENTION

This invention relates to a pressure-sensitive carbonless copy system and in particular to a system using a transfer coating composition containing a solution of an alkyl bis-(2,4 dinitrophenyl) acetate in a carrier liquid which composition is applied to a substrate. The transfer sheet produced thereby may be used in combination with a developer sheet, i.e., record sheet, having applied thereto a developer coating composition containing a strong alkali co-reactive with the alkyl bis-(2,4 dinitrophenyl) acetate to produce a color. The above mentioned coating compositions may be applied to both sides of a substrate as in manifold forms, or may be applied to the same side as in self-contained copy systems.

The color precursors utilized in practicing this invention are the bis-(2,4 dinitrophenyl) acetates having the following generic formula:

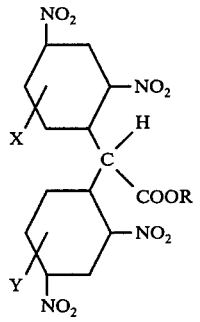

wherein R is selected from the group consisting of a $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ to $C_4$ chloroalkyl. Mixtures of compounds having the above generic formula can be used if desired.

The preferred compounds are ethyl bis-(2,4 dinitrophenyl) acetate and methyl bis-(2,4 dinitrophenyl) acetate. These acetates are presently known as acid-base indicators and the ethyl ester is commercially available from Eastman Kodak Co., Rochester, New York. A suitable method of preparing these compounds is disclosed by A. L. Bluhm et al in the *Journal of Organic Chemistry,* Vol. 29, page 636 (1964).

The carrier liquid is an oil which should be immiscible with water. Preferably, the carrier liquid should have a solubility of less than 1% in water, and likewise water should have a solubility of less than 1% in the carrier liquid. In general, the preferred carrier liquids are organic solvents which are slightly polar, such as the carboxylic acid esters, phosphate esters and sulfuric acid esters, and have a boiling point of at least about 180° C or higher. Aromatic hydrocarbons, such as monoisopropylbiphenyl can be used, but are not as satisfactory as the preferred carrier liquids due to their limited capacity to dissolve the acetate color precursors. For example, monoisopropylbiphenyl will dissolve about 3.7% by weight of the ethyl bis-(2,4 dinitrophenyl) acetate at room temperature. However, some aromatic hydrocarbons, such as monoisopropylbiphenyl, function very well as diluents for the preferred carrier liquid. The concentration of acetate color precursors can be from about 4% to about 10%, preferably from about 5% to about 8%, by weight, based on the weight of the color precursor-carrier liquid solution. Examples of carrier liquids which can be used are tributyl phosphate, trixylyl phosphate, dibutyl phthalate, dioctyl phthalate, dioctyl adipate and mixtures thereof. The most preferred carrier liquids are the trisalkylphenyl and tris-dialkylphenyl phosphates wherein the combined alkyl groups have 1 to 6 carbon atoms. In particular, trixylyl phosphate has given excellent results.

The acetate color precursor carrier liquid solution is preferably microencapsulated prior to coating on a substrate to form the transfer sheet. Microencapsulation can be effected by a variety of methods using wall-forming materials which do not react with the color precursor. For example, microencapsulation procedures involving the use of isocyanate wall-forming materials should be avoided due to reaction of the alkyl bis-(2,4 dinitrophenyl) acetate with isocyanate. Other wall-forming materials which react with the acetate color precursor should also be avoided. Microencapsulation processes in which the pH is above 8 should be avoided due to the potential for causing premature color formation at such alkaline conditions.

The acetate color precursor carrier liquid solution is preferably encapsulated in gelatin-gum arabic microcapsules. The microcapsules can be produced using the procedure of U.S. Pat. No. 3,041,289, issued June 26, 1962 to Katchen et al, except that the final step of bringing the aqueous capsule slurry to a pH of 10 is omitted and is replaced by bringing the pH of the slurry to 5.2, followed by stirring at 10° C. overnight. A process based on the Katchen procedure is described hereinafter in the example illustrating the preferred embodiment of this invention. Another microencapsulation procedure which may be used is the formation of resorcinol-formalin-PVA capsules as disclosed in U.S. Pat. No. 3,755,190; the patent was issued to Hart et al on Aug. 28, 1973.

In a preferred form of this invention, an aqueous slurry of microcapsules (transfer coating composition) containing the solution of the acetate color precursor in a carrier liquid can be coated on a substrate, such as paper or plastic film to produce the preferred transfer sheet of this invention. The preferred substrate is paper. This transfer coating composition can additionally contain a binder to adhere the microcapsules to the substrate and/or stilts to prevent smudging of the dried microcapsule coating. Binders such as the commonly used starches or polyvinyl alcohol are satisfactory. The stilts may be uncooked starch or resin granules or ground cellulose fibers.

Application of the transfer coating composition to the substrate can be by any of the known methods of applying coating compositions containing microcapsules. For example, air knife coating, roll coating or printing can be used. The dry weight of microcapsules applied is not critical. Dry weight of microcapsules of about 3 to about 5 pounds per 3300 sq. ft. of substrate are preferred.

The color developers utilized in practicing this invention are the strong bases having a $pK_b$ of below 4.8. The $pK_b$ value for any base is a measure of the alkalinity of the base and can be calculated from the dissociation constant by the following formula:

$$pK_b = \log (1/K_b)$$

where $K_b$ is the dissociation constant of the base.

The preferred color developers would include but not be limited to the alkali metal hydroxides, such hydroxides of sodium, potassium and lithium and the organic bases such as ethylenediamine, diethylenetriamine, triethylenetetramine, tetraethylenepentamine, trimethylenediamine, N-methylethylenediamine, N-ethylethylenediamine, tetramethylenediamine, N-(2-hydroxyethyl)ethylenediamine, 1,8-bis-(dimethylamino)naphthalene, butylamine, piperidine, pyrrolidine, ethanolamine, N-methylguanidine, N-methylipieridine, N-phenylguanidine, ethylamine, ethylpyrrolidine, xanthine and mixtures thereof. Mixtures of organic bases with the alkali metal hydroxides are preferred.

Color developing properties of a number of organic compounds and sodium hydroxide are given in the following table. In this test strips of filter paper were dipped into a 5% aqueous solution of the base to be tested, allowed to dry and then the base-treated strips were dipped in a 5% acetone solution of ethyl bis-(dinitrophenyl)acetate. The recorded colors were developed instantaneously and the colored strips showed no deterioration on exposure to ambient conditions for 4 days.

Color Reactions of Ethyl bis (2,4-dinitrophenyl Acetate with Various Bases

| Base | $pK_b$* | Color Formed |
|---|---|---|
| Urea | 13.82 | Little or no color |
| Amberlite CG 400 | 4.8 | Very faint blue grey |
| Sodium acetate | 4.8 | Grey blue-black |
| Ethylene diamine | 4.07 | Black |
| Diethylene triamine | ca. 4.08 | Black |
| Triethylene tetramine | 4.08 | Black |
| Tetraethylene pentamine | 4.46 | Black |
| Diethanolamine | 4.06 | Black |
| Sodium Hydroxide | ca. 0 | Black |
| Polyethyleneimine (Montrek 18) | 4.8 | Light black |
| Polyethyleneimine (Montrek 1000) | 4.8 | Light black |

*The smaller the $pK_b$ number, the stronger the base.

In an especially preferred embodiment of the invention, the color developer is applied as an aqueous mixture containing a binder, such as a styrene-butadiene latex. Pigments may be added to this developer coating composition to give it a white background, and a humectant, such as glycerin. The amount of color developer is not critical. A coating of about 0.1 to about 1.0 pounds of the active color developer per 3000 sq. ft. of substrate is preferred. The developer coating composition may be applied to a substrate, preferably paper, by any conventional application process, such as by dipping, coating or printing.

Following is an example illustrating the preferred embodiment of this invention.

EXAMPLE

Microcapsules of ethyl bis-(2,4-dinitrophenyl) acetate were prepared by a coacervation technique which involved the emulsification of a warm solution of 16.0 g. of the bis(-dinitrophenyl) acetate in 200 ml. of a trixylyl phosphate, Phosphlex 179A available from Stauffer Chemical Co., Westport, Conn., in an aqueous solution of gelatin containing 18 grams of gelatin in 270 ml. of water previously brought to a pH of 6.5. The emulsion was stirred into a solution of 37 g. of gum arabic in 810 g. water at 50° C., agitated for five minutes and 0.64 g. of poly(methylvinylether/maleic anhydride) copolymer in 5% aqueous solution was added. The emulsion was stirred about 10 minutes, brought to a pH of 4.8 and cooled to 10° C. After 15 minutes of stirring, the coacervate was treated with 10 ml. of 50% glutaraldehyde, stirred for 30 minutes at 10° C., brought to a pH of 5.2 and stirred overnight at 10° C to form an aqueous slurry of microcapsules.

The aqueous slurry of microcapsules was coated with a No. 18 Mayer Bar on a 15# per 1300 square foot bond paper to form transfer sheets.

A developer coating composition was prepared by mixing the following ingredients in an attritor for 15 minutes:

| Ingredient | Parts by Weight |
|---|---|
| Water | 100 g. |
| Dow Latex 620 | |

-continued

| Ingredient | Parts by Weight |
|---|---|
| (butadiene-styrene latex) | 6 g. |
| $CaCO_3$ | 5 g. |
| Tetraethylenepentamine | 6 g. |
| Sodium hydroxide | 0.5 g. |
| Glycerine | 0.5 g. |

The developer coating composition was coated on 15# bond paper with a No. 10 Mayer bar and dried to form a record sheet.

The transfer and record sheet prepared above were tested by placing the coating surfaces thereof in contact with each other. These sheet couples were then imaged with an electric typewriter using the character "m" in a repeating block pattern, and the intensity of the images was measured as the ratio of the reflectance of the imaged area to the reflectance of the unimaged background, after an elapsed time of 10 minutes. Thus, the more intense or darker images show as lower values, and higher values indicate weak or faint images. This test is called Typewriter intensity and may be expressed mathematically as $$T.I. = (100)(R_i/R_o)$$

where $R_i$ is reflectance of the imaged area and $R_o$ is reflectance of the background (unimaged) area as measured with a Bausch and Lomb Opacimeter. A blue-grey image was formed instantaneously on the record sheet. The image darkened on ageing as shown from the following typewriter intensity tests.

| Time After Imaging | Typewriter Intensity |
|---|---|
| 10 minutes | 81.2 |
| 30 minutes | 78.4 |
| 17 hours | 69.0 |
| 3 days | 64.7 |

The pressure sensitive carbonless copy system of this invention may take one of several forms so long as the color precursor is present in the system as an oil solution of the precursor and so long as the color developer is isolated from the color precursor, for example by encapsulation of the oil solution of the precursor and/or by separation of the color precursor and color developing coatings.

Transfer and record sheets produced as in the foregoing example may be assembled as in the typewriter intensity test to produce a two part manifold forms. They may also be interspersed with one or several sheets having the transfer coating on one side of a substrate and the development coating on the opposite side of the substrate to produce multi-part manifold forms of three parts or more.

A self-contained sheet may be produced by applying the transfer and development coatings in two separate layers. Alternatively, the transfer and development coating compositions may be mixed together and applied to a substrate to produce another form of self-contained copy sheet.

What is claimed is:

1. A pressure-sensitive carbonless copy system comprising a transfer sheet and a developer sheet, said transfer sheet comprising a paper substrate having a plurality of surfaces and having applied thereto on at least one of said surfaces microcapsules containing a solution of a color precursor in a carrier liquid, said carrier liquid being an oil immiscible with water, said color precursor having the following formula:

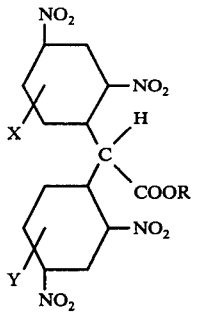

wherein R is selected from the group consisting of a $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ to $C_4$ chloroalkyl, and said developer sheet being a paper substrate having a plurality of surfaces and having applied thereto on one of said surfaces an alkaline color developer selected from the group consisting of the hydroxides of sodium, potassium and lithium and ethylenediamine, diethylenetriamine, triethylenetetramine, tetraethylenepentamine, trimethylenediamine, N-methylethylenediamine, N-ethylethylenediamine, tetramethylenediamine, N-(2-hydroxyethyl)ethylenediamine, 1,8-bis-(dimethylamino)naphthalene, butylamine, piperidine, pyrrolidine, ethanolamine, N-methylguanidine, N-methylpiperidine, N-phenylguanidine, ethylamine, ethylpyrrolidine, xanthine and mixtures thereof.

2. The pressure-sensitive carbonless copy system of claim 1 wherein said carrier liquid is selected from the group consisting of tris-(monoalkylphenyl) phosphates, tris-(dialkylphenyl) phosphates wherein the combined alkyl groups have 1 to 6 carbon atoms and mixtures thereof.

3. A pressure-sensitive carbonless copy system comprising a transfer sheet and a developer sheet, said transfer sheet comprising a paper substrate coated with gelatin microcapsules containing a solution of ethyl bis-(2,4 dinitrophenyl) acetate in trixylyl phosphate and said developer sheet comprising a paper substrate coated with an alkaline coating containing tetraethylenepentamine.

4. A pressure-sensitive carbonless copy sheet comprising a substrate having a plurality of surfaces having applied thereto on at least one of said surfaces a coating containing a solution of a color precursor in a carrier liquid, said carrier liquid being an oil immiscible with water, and said color precursor having the following formula:

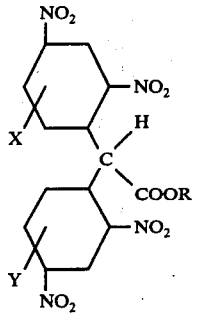

wherein R is selected from the group consisting of a $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ and $C_4$ chloroalkyl.

5. The pressure-sensitive carbonless copy sheet of claim 4 wherein said substrate is paper.

6. The pressure-sensitive carbonless copy sheet of claim 4 wherein said carrier liquid is an organic solvent.

7. The pressure-sensitive carbonless copy sheet of claim 4 wherein said solution of said color precursor is microencapsulated.

8. The pressure-sensitive carbonless copy sheet of claim 4 wherein said color precursor is ethyl bis-(2,4 dinitrophenyl) acetate.

9. A pressure-sensitive carbonless copy sheet comprising a paper substrate having a plurality of surfaces and having applied thereto on at least one of said surfaces microcapsules containing a solution of a color precursor in a carrier liquid, said carrier liquid being an oil immiscible with water, said color precursor having the following formula:

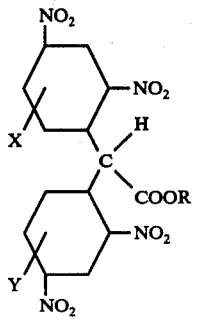

wherein R is selected from the group consisting of a $C_1$ to $C_4$ alkyl, methoxymethyl, methoxyethyl, ethoxymethyl and $C_1$ to $C_4$ chloroalkyl and X and Y are separately selected from the group consisting of hydrogen, a halogen, $C_1$ to $C_4$ alkyl, $C_1$ to $C_4$ alkoxy and $C_1$ to $C_4$ chloroalkyl.

10. The pressure-sensitive carbonless copy sheet of claim 9 wherein said carrier liquid is selected from the group consisting of tris-(monoalkylphenyl) phosphates and tris-(dialkylphenyl) phosphates wherein the combined alkyl groups have 1 to 6 carbon atoms and mixtures thereof.

11. The pressure-sensitive carbonless copy sheet of claim 9 wherein said tris-(dialkylphenyl) phosphate is trixylyl phosphate.

12. The pressure-sensitive carbonless copy sheet of claim 9 wherein said color precursor is ethyl bis-(2,4 dinitrophenyl)acetate.

13. A pressure-sensitive carbonless copy sheet comprising a paper substrate having applied thereto a coating of gelatin microcapsules containing a solution of ethyl bis-(2,4 dinitrophenyl) acetate in a carrier liquid, said carrier liquid being a tris-(dialkylphenyl) phosphate wherein the combined alkyl groups have 1 to 6 carbon atoms.

14. The pressure-sensitive carbonless copy paper of claim 13 wherein said carrier liquid is trixylyl phosphate.

15. The pressure-sensitive carbonless copy paper of claim 13 wherein said coating of gelatin microcapsules includes uncooked starch granules.

* * * * *